US009124049B2

(12) United States Patent
Yuen

(10) Patent No.: US 9,124,049 B2
(45) Date of Patent: Sep. 1, 2015

(54) MICRO ETHERNET CONNECTOR

(71) Applicant: Silicon Graphics International Corp., Milpitas, CA (US)

(72) Inventor: Peter Siltex Yuen, San Jose, CA (US)

(73) Assignee: Silicon Graphics International Corp., Milpitas, CA (US)

( * ) Notice: Subject to any disclaimer, the term of this patent is extended or adjusted under 35 U.S.C. 154(b) by 53 days.

(21) Appl. No.: 13/853,943

(22) Filed: Mar. 29, 2013

(65) Prior Publication Data

US 2014/0273601 A1 Sep. 18, 2014

Related U.S. Application Data

(60) Provisional application No. 61/779,351, filed on Mar. 13, 2013.

(51) Int. Cl.

| | |
|---|---|
| ***H01R 24/00*** | (2011.01) |
| ***H01R 24/60*** | (2011.01) |
| ***H01R 24/64*** | (2011.01) |
| ***H01R 13/502*** | (2006.01) |
| ***H01R 13/66*** | (2006.01) |
| ***H01R 13/6581*** | (2011.01) |
| ***H01R 13/6599*** | (2011.01) |
| *H01R 12/50* | (2011.01) |
| *H01R 24/68* | (2011.01) |

(52) U.S. Cl.

CPC ..... *H01R 24/60* (2013.01); *H01R 13/502* (2013.01); *H01R 13/6581* (2013.01); *H01R 13/6599* (2013.01); *H01R 13/6658* (2013.01); *H01R 24/64* (2013.01); *H01R 23/7073* (2013.01); *H01R 24/68* (2013.01)

(58) Field of Classification Search

CPC ..... G06F 1/182; G06F 1/181; H01R 24/62; H01R 13/6583; H01R 13/6658; H01R 23/7073; H01R 23/02

USPC ..... 439/660

See application file for complete search history.

(56) References Cited

U.S. PATENT DOCUMENTS

| | | | |
|---|---|---|---|
| 4,898,009 | A | 2/1990 | Lakoski |
| 5,045,636 | A | 9/1991 | Johnasen |
| 5,202,536 | A | 4/1993 | Buonanno |
| 5,347,430 | A | 9/1994 | Curlee |
| 5,351,176 | A | 9/1994 | Oliver |
| 5,392,192 | A | 2/1995 | Dunn |
| 5,466,059 | A | 11/1995 | Liu |
| 5,564,930 | A | 10/1996 | Yu |

(Continued)

OTHER PUBLICATIONS

U.S. Appl. No. 11/125,424 Office Action mailed Dec. 20, 2007.

(Continued)

*Primary Examiner* — Michael Zarroli

(74) *Attorney, Agent, or Firm* — Lewis Roca Rothgerber LLP

(57) ABSTRACT

In an embodiment, a micro ethernet connector includes an outer housing that has a recessed front end and a back end. The micro ethernet connector further includes an inner housing that is disposed within the recessed front end of the outer housing. The inner housing has an exposed end. The exposed end includes a recessed channel. The volume of the recessed channel is substantially equal to the volume of a correspondingly shaped protruding printed circuit board of a male micro ethernet connector. A plurality of spring-biased connectors are disposed within the recessed channel of the inner housing.

11 Claims, 5 Drawing Sheets

(56) References Cited

U.S. PATENT DOCUMENTS

| | | | | |
|---|---|---|---|---|
| 5,569,878 | A | 10/1996 | Zielinski | |
| 5,684,271 | A | 11/1997 | Scholder | |
| 5,726,866 | A | 3/1998 | Allen | |
| 5,822,182 | A | 10/1998 | Radloff | |
| 5,977,480 | A | 11/1999 | Timieski | |
| 6,023,415 | A | 2/2000 | Dean | |
| 6,114,622 | A | 9/2000 | Draeger | |
| 6,125,031 | A | 9/2000 | Fiora | |
| 6,163,454 | A | 12/2000 | Strickler | |
| 6,215,659 | B1 | 4/2001 | Chen | |
| 6,229,714 | B1 | 5/2001 | Rosales | |
| 6,239,358 | B1 | 5/2001 | Chang | |
| 6,252,160 | B1 | 6/2001 | Chang | |
| 6,346,012 | B1 * | 2/2002 | Cheng et al. | 439/632 |
| 6,349,042 | B1 | 2/2002 | Mills | |
| 6,414,851 | B2 | 7/2002 | Cherniski | |
| 6,477,061 | B1 | 11/2002 | Johnson | |
| 6,480,398 | B1 | 11/2002 | Fiora | |
| 6,496,366 | B1 | 12/2002 | Coglitore | |
| 6,512,673 | B1 | 1/2003 | Wiley | |
| 6,560,114 | B2 | 5/2003 | Berry | |
| 6,621,000 | B2 | 9/2003 | Jensen | |
| 6,628,512 | B2 | 9/2003 | Searby | |
| 6,718,408 | B2 | 4/2004 | Esterberg | |
| 6,862,173 | B1 | 3/2005 | Konshak | |
| 7,042,720 | B1 | 5/2006 | Konshak | |
| 7,411,784 | B2 | 8/2008 | Coglitore | |
| 7,905,750 | B2 * | 3/2011 | Mo | 439/541.5 |
| 8,251,746 | B2 * | 8/2012 | Zhang et al. | 439/607.11 |
| 8,337,253 | B2 * | 12/2012 | Gao et al. | 439/660 |
| 8,550,858 | B2 * | 10/2013 | Reid | 439/639 |
| 8,888,536 | B2 * | 11/2014 | Degner | 439/660 |
| 2003/0124971 | A1 | 7/2003 | Williams | |
| 2003/0128516 | A1 | 7/2003 | Lorenzo | |
| 2005/0265004 | A1 | 12/2005 | Coglitore | |
| 2009/0305570 | A1 * | 12/2009 | Farole et al. | 439/660 |
| 2010/0091452 | A1 * | 4/2010 | Raff et al. | 361/679.55 |
| 2011/0237134 | A1 * | 9/2011 | Gao et al. | 439/660 |
| 2013/0196549 | A1 * | 8/2013 | Sorani | 439/660 |
| 2013/0288520 | A1 * | 10/2013 | Simmel et al. | 439/607.01 |
| 2014/0113487 | A1 * | 4/2014 | Chen et al. | 439/607.01 |
| 2015/0056867 | A1 | 2/2015 | Yuen | |

OTHER PUBLICATIONS

U.S. Appl. No. 14/529,050, filed Oct. 30, 2014, Peter Siltex Yuen, Micro Ethernet Connector.

* cited by examiner

200

400

500

MICRO ETHERNET CONNECTOR

CROSS REFERENCE TO RELATED APPLICATIONS

This application claims the priority benefit of U.S. Provisional Application Ser. No. 61/779,351, titled "Micro Ethernet Connector," filed Mar. 13, 2013, the disclosure of which is incorporated herein by reference.

BACKGROUND

1. Field of the Invention

The presently claimed invention relates to ethernet connectors. More specifically, it relates to micro ethernet connectors.

2. Description of the Related Art

Many modern computing devices that communicate over a network utilize a standard ethernet connector known as an eight position eight contact (8P8C) connector—sometimes referred to as a RJ45 connector. Though the RJ45 ethernet connectors are utilized in a myriad of computing devices, such as servers, personal computers, modems, routers, printers, televisions, and gaming consoles, the standard RJ45 ethernet connector design has remained unchanged for over forty years. Although it provides an ethernet connection, the standard RJ45 ethernet connector is spatially inefficient, is limited to only eight connection points, and is extremely prone to breaking. As consumers continue to demand increasingly reliable ethernet connections, there is an increasingly evident need in the art for an improved ethernet connector that maintains reliability and utilizes a more durable design than the RJ45 connector.

SUMMARY

The micro ethernet connector of the present invention provides for improved spatially economy, connectivity, and durability over previously attempted ethernet connector solutions. In one embodiment, a micro ethernet connector includes an outer housing that has a recessed front end and a back end. The micro ethernet connector further includes an inner housing that is disposed within the recessed front end of the outer housing. The inner housing has an exposed end which includes a recessed channel. The volume of the recessed channel may be substantially equal to the volume of a correspondingly shaped protruding printed circuit board of a male micro ethernet connector. A plurality of spring-biased connectors may be disposed within the recessed channel of the inner housing. The spring-biased connectors hold the printed circuit board of the male micro ethernet connector in place when the same is inserted. As a result, the present invention does not require the use of detents or tabular components that are prone to breaking when a user manual manipulates the present invention. The overall design of the present invention may occupy substantially less space in input/output panels than the traditional RJ45 connector.

In another embodiment, a micro ethernet connector includes an outer housing that has a recessed front end and a back end. A protruding printed circuit board is disposed within the recessed front end of the outer housing. The volume of the printed circuit board may be substantially equal to the volume of a correspondingly shaped recessed channel of a female micro ethernet connector. A plurality of conductive traces may be disposed on the protruding printed circuit board. The use of conductive traces allows for more than the eight connection points to which the traditional RJ45 connector is limited.

DETAILED DESCRIPTION

A micro ethernet connector is provided. The micro ethernet connector of the present invention provide for improved spatially economy, connectivity, and durability over previously attempted ethernet connector solutions such as the RJ45 connector. Namely, the present invention takes up substantially less space on input/output panels of servers or other computers. It also utilizes spring-biased connectors to hold the male connector securely coupled to the female connector rather than using detents or tabular members that are prone to breaking whenever a user manually manipulates the connector. As a result, a user using the present invention is less likely to have to replace an ethernet connector or experience connectivity failures that occur as a result of the male and female connectors becoming uncoupled. Embodiments of the present invention may also feature more connection points than the standard RJ45 connector and may shield those connectors with a continuous metal shield to protect the connection from external interference.

The micro ethernet connector system includes a male end and a female end. The micro ethernet of the present technology may include shielding to protect conductivity from external interference. The present connector has a sleek mechanical design that reduces the likelihood of breakage due to normal wear and tear. As described below, the male micro ethernet connector may be coupled to the female micro ethernet connector to communicate an ethernet signal through the coupled ends. Because 8P8C are widely referred to as registered jack 45 (RJ45) connectors, this disclosure utilizes the term RJ45 in reference to the same.

Figure 1:
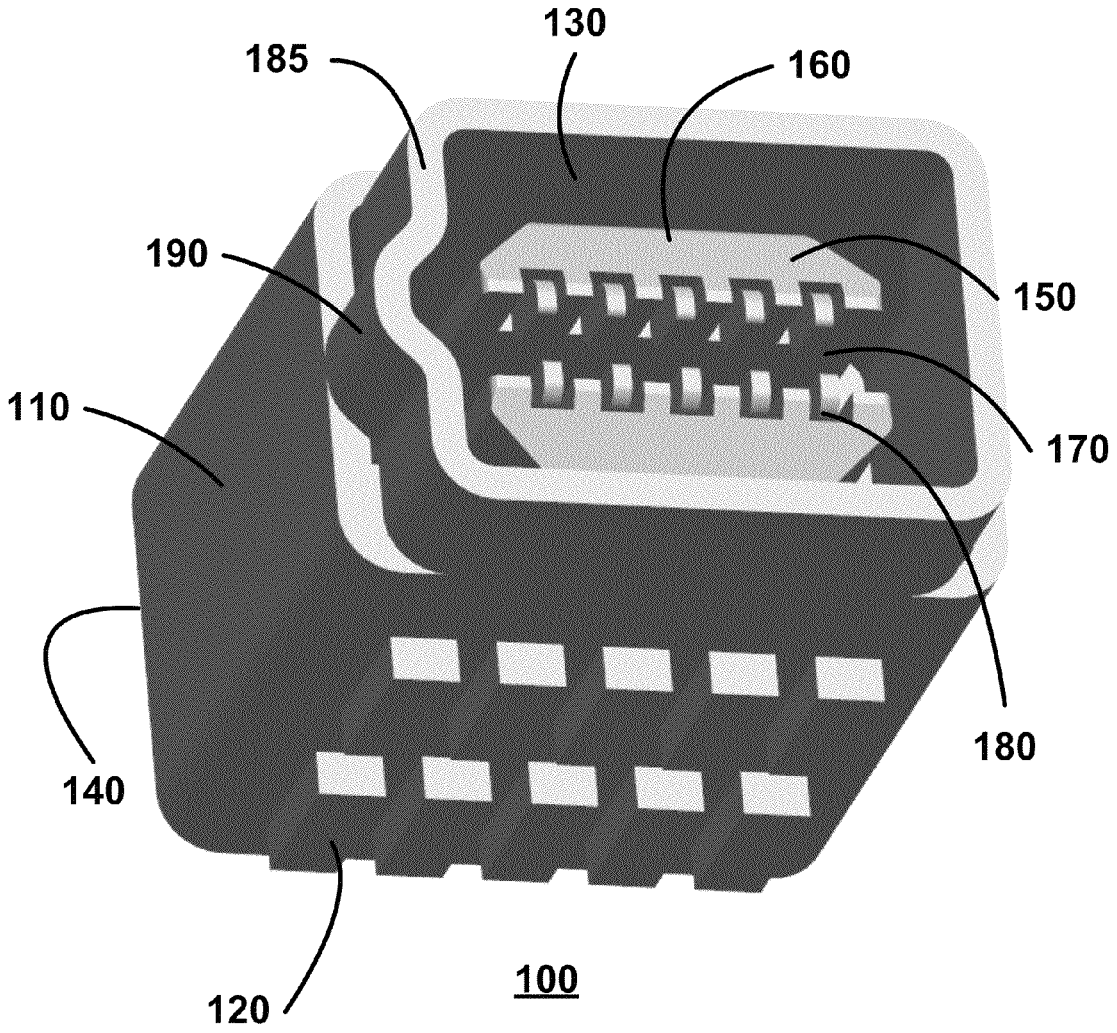
FIG. 1 is a perspective view of an exemplary male micro ethernet connector in accordance with the presently claimed invention.

FIG. 1 is a perspective view of an exemplary female micro ethernet connector in accordance with the presently claimed invention. A micro ethernet connector 100 includes an outer housing 110. The front surface area of outer housing 110 may be at least 25% less than the front surface area of a standard female RJ45 connector. In one embodiment, outer housing 110 may have a width of 0.31 inches, a height of 0.20 inches, and a depth of 0.38 inches. In other embodiments, other dimensions may be utilized.

Micro ethernet connector 100 may include a plurality of solder pads 120 disposed on the outer housing 110. Alternatively, micro ethernet connector 100 may include any number of other structures or materials that are suitable for securely mounting micro ethernet connector 100 to a motherboard or other computer hardware component. Such structures and materials will be readily recognized by a person of ordinary skill in the art.

Outer housing 110 includes a recessed front end 130 and a back end 140. An inner housing 150 is disposed within recessed front end 130 of outer housing 110. Inner housing 150 includes an exposed end 160. Exposed end 160 includes a recessed channel 170. The volume of recessed channel 170 may be substantially equal to the volume of a correspondingly shaped protruding printed circuit board of a male micro ethernet connector (shown in FIGS. 3 and 4).

A plurality of spring-biased connectors 180 may be disposed within recessed channel 170 of inner housing 150. Spring-biased connectors 170 may be biased towards pressing against a plurality of conductive traces that are disposed on a correspondingly shaped protruding printed circuit board of a male micro ethernet connector when a printed circuit board is inserted into recessed channel 170. In one embodiment, micro ethernet connector 100 may include ten spring-biased connectors 180. In other embodiments, more or less spring-biased connectors 180 may be utilized depending on connectivity needs and design constraints. Because the presently claimed invention may include ten or more spring-biased connectors 180 compared to the eight signal connections offered by standard RJ45 ethernet connectors, the presently claimed invention provides increased design flexibility and overall signal connectivity.

Micro ethernet connector 100 may also include a shield 185 disposed circumferentially around a rim of recessed front end 130. The shape of shield 185 may corresponds to the shape of a shield of a male micro ethernet connector (shown in FIGS. 3 and 4). The shape of shield 185 may also include a unique region 190 that corresponds to a unique region in the shape of a shield of a male micro ethernet connector. Unique region 190 may be an indention or protrusion of any shape and may intend or protrude either inward or outwards. Shield 185 may include metal, metal and plastic, or any other suitable materials that persons of ordinary skill in the art will readily recognize as capable of reducing external interference.

Figure 5:
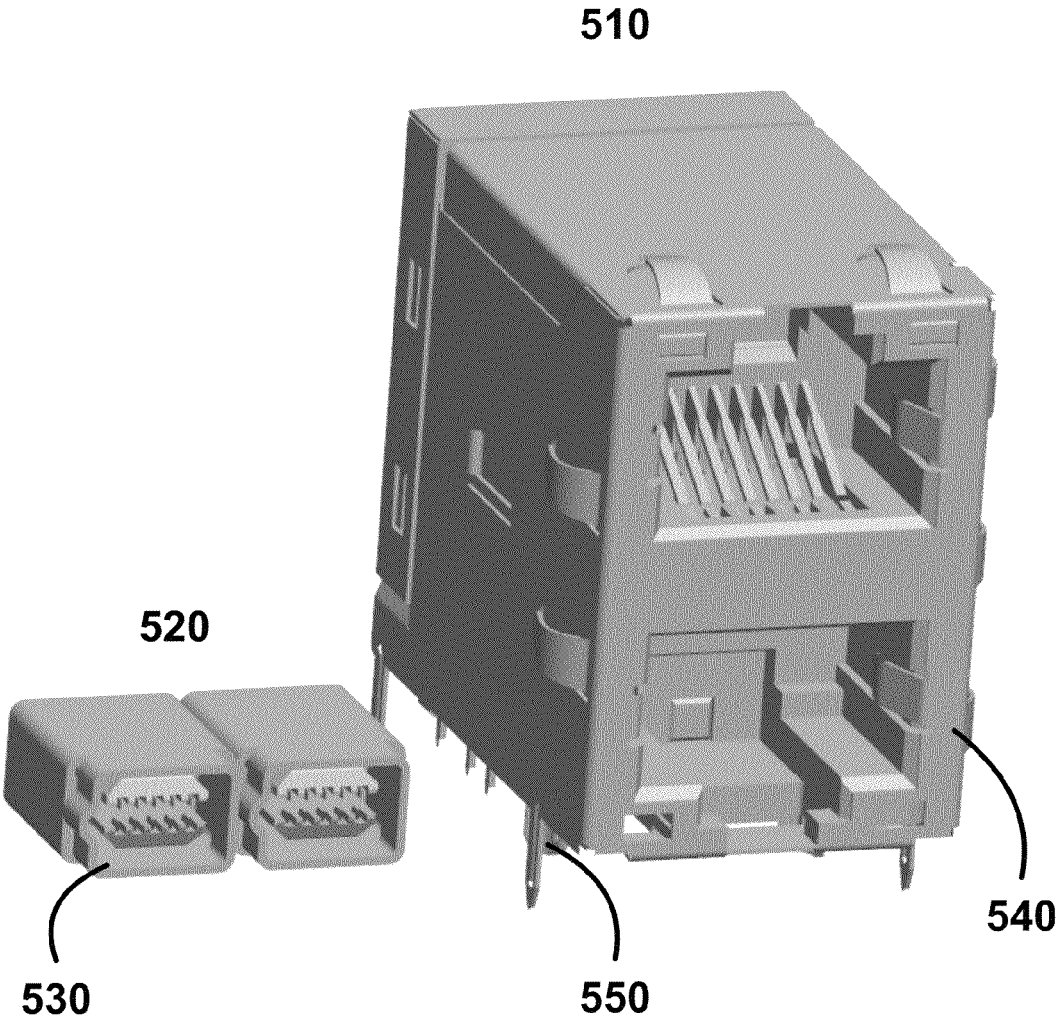
FIG. 5 is a perspective view of an exemplary double female micro ethernet connector compared to a standard double female RJ45 connector.

Micro ethernet connector 100 may be used individually, or it may used adjacent to other micro ethernet connectors 100, such as in a double connection configuration (shown in FIG. 5). As many micro ethernet connectors 100 as necessary may be used together in various configurations, such as in a two-by-two, three-by-three, or two-by-three matrix.

Figure 2:
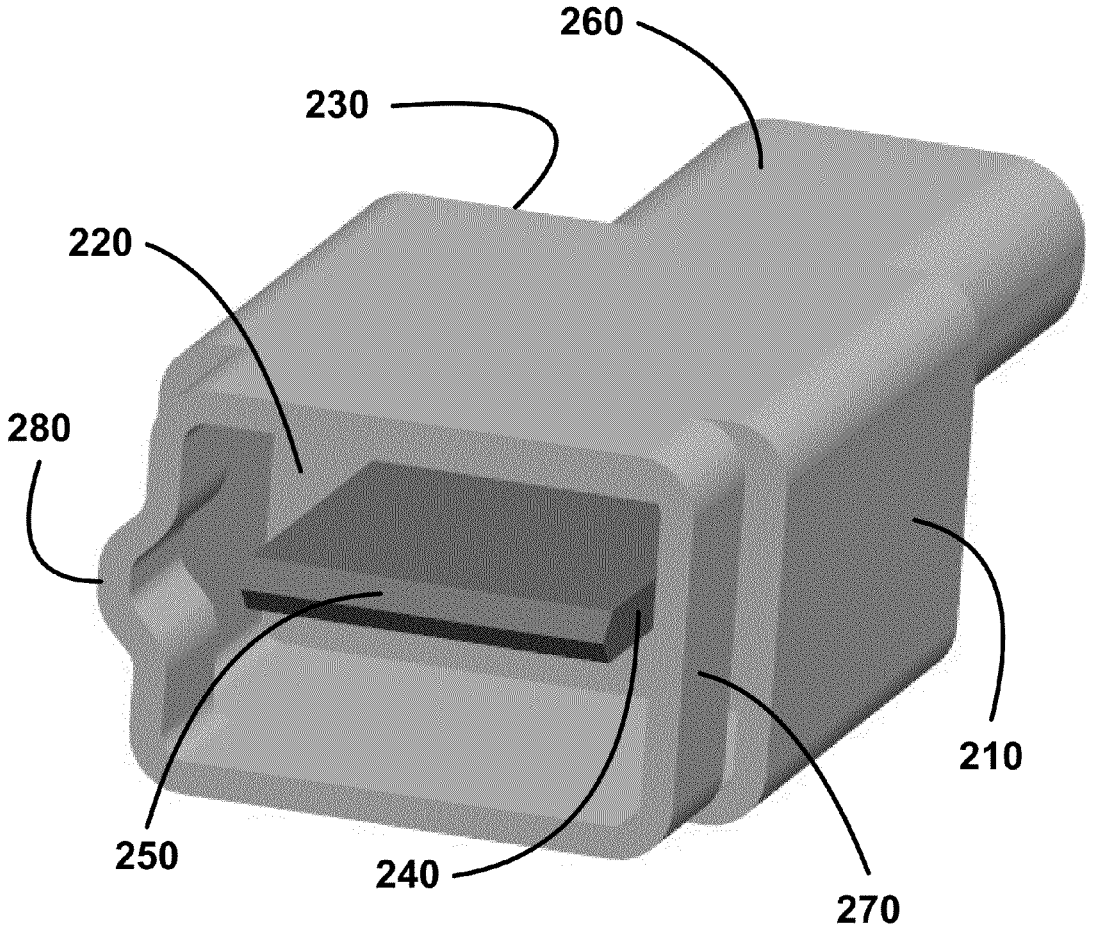
FIG. 2 is a perspective view of an exemplary female micro ethernet connector in accordance with the presently claimed invention.

FIG. 2 is a perspective view of an exemplary male micro ethernet connector in accordance with the presently claimed invention. A micro ethernet connector 200 includes an outer housing 210 that has a recessed front end 220 and a back end 230. The front surface area of outer housing 210 may be at least 25% less than the front surface area of a standard male RJ45 connector. In one embodiment, outer housing 210 may have a width of 0.25 inches, a height of 0.16 inches, and a depth of 0.4 inches.

A protruding printed circuit board 240 is disposed within recessed front end 220 of outer housing 210. The volume of printed circuit board 240 may be substantially equal to the volume of a correspondingly shaped recessed channel of a female micro ethernet connector (shown in FIG. 1). Protruding printed circuit board 240 may include a chisel-shaped front end 250. Chisel-shaped front end 250 may force into an unbiased position a plurality of spring-biased connectors disposed in a correspondingly shaped recessed channel of a female micro ethernet connector. A plurality of conductive traces (not shown) may be disposed on protruding printed circuit board 240. Back end 230 of outer housing 210 may be coupled to an ethernet cable 260 that provides an ethernet signal.

Micro ethernet connector 200 may further include a shield 270 disposed circumferentially around a rim of recessed front end 220. The shape of shield 270 may correspond to the shape of a shield of a female micro ethernet connector (shown in FIGS. 3 and 4). The shape of shield 270 may include a unique region 280 that corresponds to a unique region in the shape of the shield of the female micro ethernet connector. Shield 270 may include metal, metal and plastic, or any other suitable materials that persons of ordinary skill in the art will readily recognize as capable of reducing external interference.

In some embodiments, micro ethernet connector 200 may be used individually. In other embodiments, micro ethernet connector 200 may used adjacent to other micro ethernet connectors 200, such as in a double connection configuration (shown in FIG. 5). As many micro ethernet connectors 200 as necessary may be used together in various configurations, such as in a two-by-two, three-by-three, or two-by-three matrix.

Figure 3:
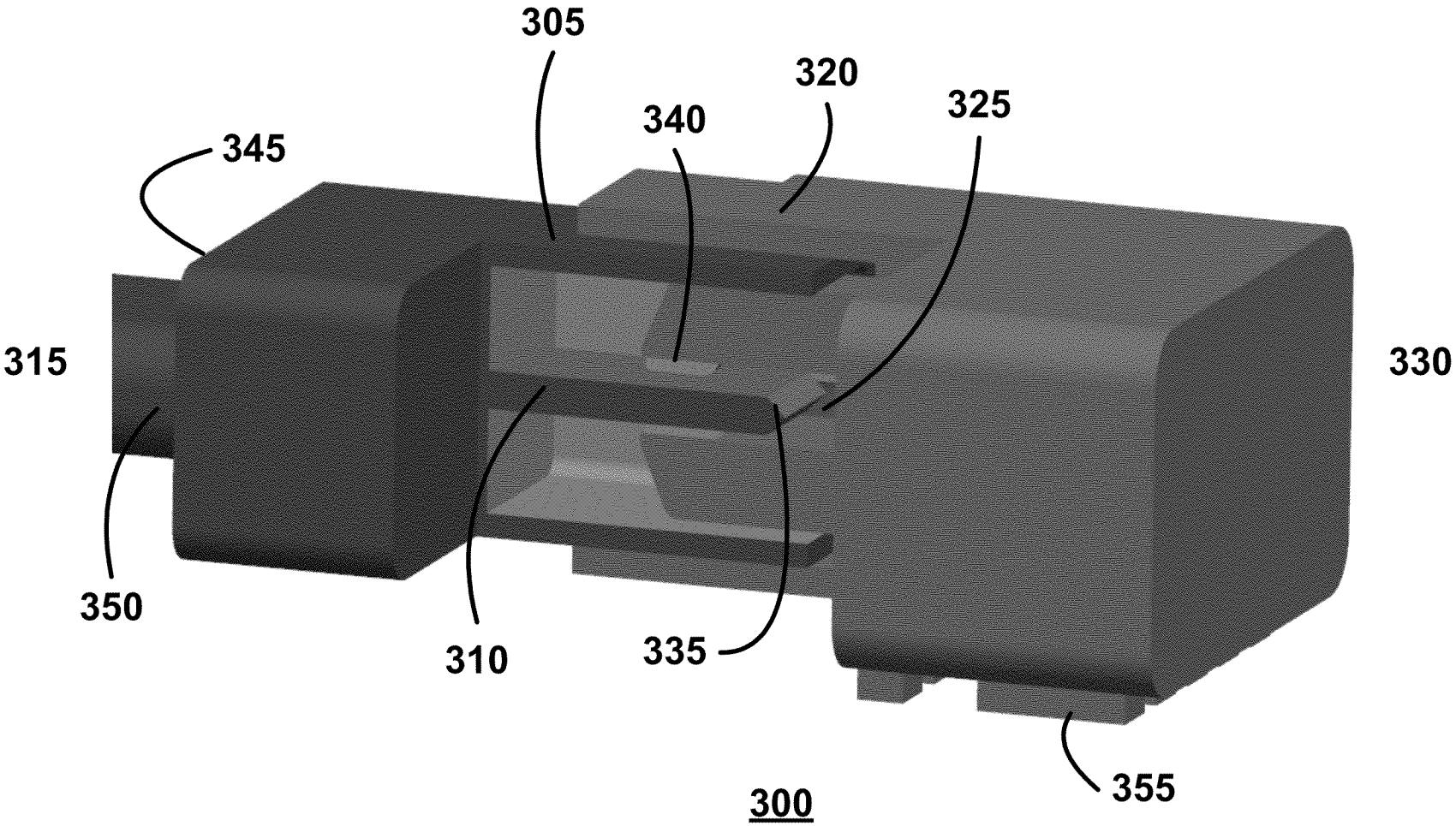
FIG. 3 is an angled cross-sectional view of an exemplary male micro ethernet connector coupled to an exemplary female micro ethernet connector.

FIG. 3 is an angled cross-sectional view of female micro ethernet connector 100 of FIG. 1 coupled to male micro ethernet connector 200 of FIG. 2. In operation, ethernet connection 300 may be established when outer housing 305 and protruding printed circuit board 310 of male micro ethernet connector 315 slide within outer housing 320 and recessed channel 325 of female micro ethernet connector 330, respectively.

Protruding printed circuit board 310 may include a chisel-shaped front end 335. In such embodiments, as chisel-shaped front end 335 is initially forced into corresponding shaped recessed channel 325 of female micro ethernet connector 330, chisel-shaped front end 335 forces spring-biased connectors 340 into their unbiased position. Where the volume of printed circuit board 310 is substantially equal to the volume of correspondingly shaped recessed channel 325, printed circuit board 310 holds spring-biased connectors 340 in their unbiased open position and allows printed circuit board 310 to slide into recessed channel 325. Because connectors 340 are spring-biased towards printed circuit board 310, they press against printed circuit board 310 when attempting to return towards their biased position. In doing so, spring-biased connectors 340 contact a plurality of conductive traces (not shown) that are disposed on protruding printed circuit board 310 and also hold printed circuit board 310 securely in place. Although spring-biased connectors are described herein for purposes of illustration, a number of other suitable conductivity mechanisms may be utilized as will be readily recognized by persons of ordinary skill in the art.

In one embodiment, micro ethernet connector 200 may include ten conductive traces. In other embodiments, more or less conductive traces may be utilized depending on connectivity needs. Because the presently claimed invention may include ten or more conductive traces compared to the eight signal connections offered by standard RJ45 ethernet connectors, the presently claimed invention provides increased design flexibility and overall signal connectivity.

Back end 345 of outer housing 305 of male micro ethernet connector 315 may be coupled to an ethernet cable 350 that provides an ethernet signal. Accordingly, when spring-biased connectors 340 of female micro ethernet connector 330 contact the conductive traces on printed circuit board 310 of male micro ethernet connector 315, a conductive pathway is created whereby male micro ethernet connector 315 may provide an ethernet signal to female micro ethernet connector 330. Outer housing 320 of female micro ethernet connector 330 may further include a plurality of solder pads 355 or other suitable structures or materials for mounting female micro ethernet connector 330 on a motherboard or other computer hardware component.

Figure 4:
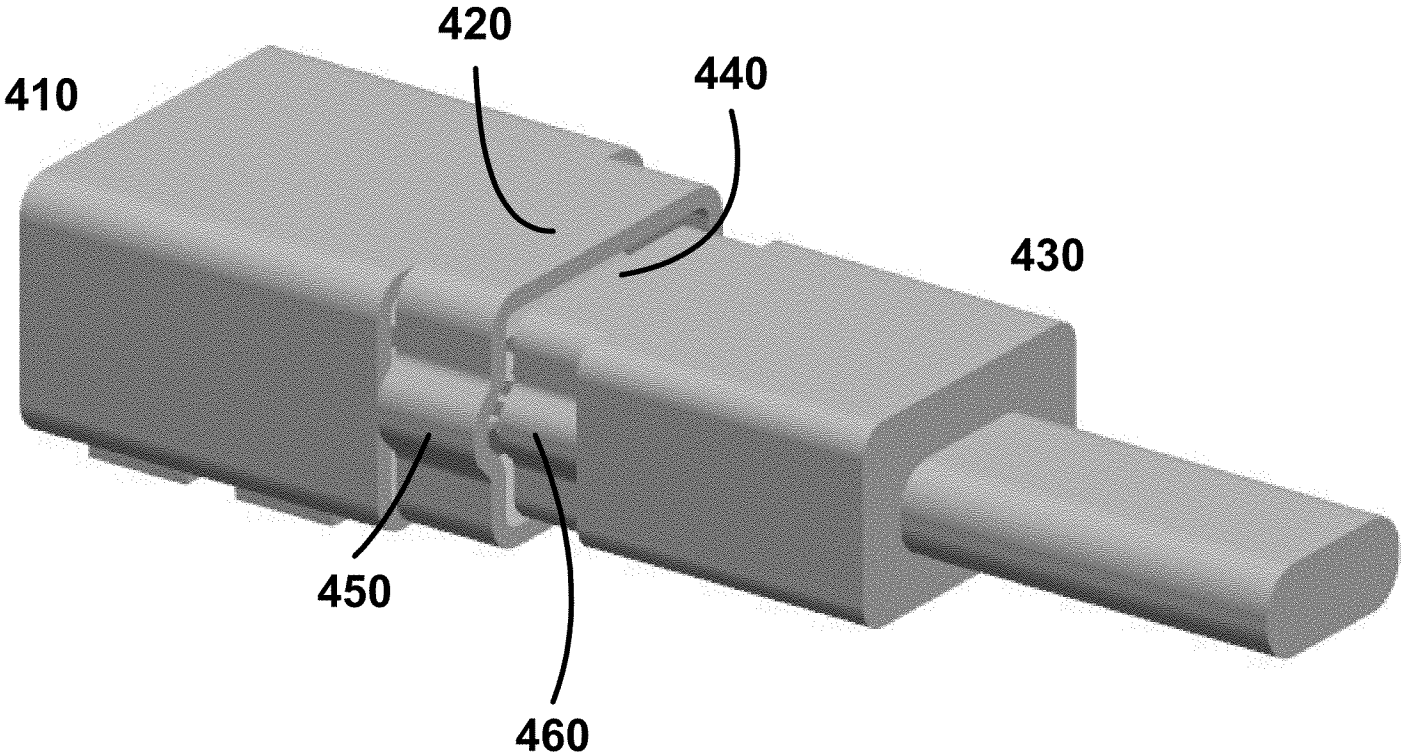
FIG. 4 is a perspective view of an exemplary male micro ethernet connector coupled to an exemplary female micro ethernet connector.

FIG. 4 is a perspective view of an exemplary male micro ethernet connector coupled to an exemplary female micro ethernet connector. Ethernet connection 400 may include female micro ethernet connector 410, which may include a shield 420, and male micro ethernet connector 430, which may include a shield 440. Shields 420 and 440 may continuously encompass the conductive connection shown in FIG. 3 to reduce outside electrical interference. In doing so, shields 420 and 440 may allow various embodiments of the presently claimed invention to provide superior signal integrity over previous ethernet connectors. Shields 420 and 440 may take a variety of shapes, such as substantially rectangular, triangular, circular, or elliptical. Shields 420 and 440 may include metal, plastic and metal, or any materials capable of reducing electrical interference. Such materials will be readily recognized by persons of ordinary skill in the art.

Shields 420 and 440 may include one or more unique regions 450 and 460, respectively. In such embodiments, unique regions 450 and 460 may need to be aligned in order for shield 420 of female micro ethernet connector 410 to couple to shield 440 of male micro ethernet connector 430. As a result, unique regions 450 and 460 help to ensure a uniform coupling orientation between female micro ethernet connector 410 and male micro ethernet connector 430. Unique regions 450 and 460 also help to keep female micro ethernet connector 410 and male micro ethernet connector 430 securely coupled to one another. This configuration, either alone or in combination with the spring-biased connectors 340 of FIG. 3, eliminates the need for any external detent-like tabs like those used in previous ethernet connectors. Such tabs are fragile and extremely prone to breaking.

As noted above, the various exemplary micro ethernet connectors disclosed herein may occupy at least 25% less surface area than the surface area of standard RJ45 connectors. FIG. 5 shows an size comparison between a standard double female RJ45 connector 510 and an exemplary double female micro ethernet connector 520 according to the presently claimed invention. The embodiment of FIG. 5 illustrates connectors that are stacked in a vertical configuration rather than a horizontal configuration. This is another example of the flexibility in which the connectors of the present invention may be configured together. Double female micro ethernet connector 520 may include a front surface area 530 that is only 18.5% of a front surface area 540 of standard double female RJ45 connector 510. For example, front surface area 540 of standard double female RJ45 connector 510 is typically 0.672 square inches (excluding grounding feet 550), while front surface area 530 of double female micro ethernet connector 520 is only 0.124 square inches. Because the presently claimed invention occupies a fraction of the surface area required by previous ethernet connectors, servers, routers, and other computing devices may free up additional input/output terminal space for other terminals or for additional micro ethernet connectors. For example, a router using the micro ethernet connections disclosed herein may support at least five times more ethernet connections as a router utilizing previous ethernet connector solutions.

The foregoing detailed description of the technology herein has been presented for purposes of illustration and description. It is not intended to be exhaustive or to limit the technology to the precise form disclosed. Many modifications and variations are possible in light of the above teaching. The described embodiments were chosen in order to best explain the principles of the technology and its practical application to thereby enable others skilled in the art to best utilize the technology in various embodiments and with various modifications as are suited to the particular use contemplated. It is intended that the scope of the technology be defined by the claims appended hereto.

What is claimed is:

1. A micro Ethernet connector, comprising:

an outer housing having a recessed front end and a back end;

an inner housing disposed within the recessed front end of the outer housing, the inner housing having an exposed end, the exposed end including a recessed channel, the volume of the recessed channel being substantially equal to the volume of a correspondingly shaped protruding printed circuit board of a male micro Ethernet connector;

a plurality of spring-biased connectors disposed within the recessed channel of the inner housing; and a shape disposed on a side surface of the inner housing of the micro Ethernet connector that corresponds to a shape on a side surface of a male micro Ethernet connector, the male Ethernet connector fitting into the inner housing of the micro Ethernet connector such that shape on the side surface of the male Ethernet connector abuts into the shape on the side surface of the inner housing of the micro Ethernet connector.

2. The micro Ethernet connector of claim 1, wherein the spring-biased connectors are biased towards pressing against a plurality of conductive traces disposed on the correspondingly shaped protruding printed circuit board of the male micro Ethernet connector when the printed circuit board is inserted into the recessed channel.

3. The micro Ethernet connector of claim 1, further comprising a shield disposed circumferentially around a rim of the recessed region.

4. The micro Ethernet connector of claim 3, wherein the shape of the shield corresponds to the shape of a shield of the male micro Ethernet connector.

5. The micro Ethernet connector of claim 3, wherein the shield includes metal.

6. The micro Ethernet connector of claim 3, wherein the shield includes metal and plastic.

7. The micro Ethernet connector of claim 4, wherein the shape of the shield includes the shape disposed on the side surface of the micro Ethernet connector, and the shield on the male micro Ethernet connector electrically connects with the shield of the micro Ethernet connector.

8. The micro Ethernet connector of claim 1, further comprising a plurality of solder pads disposed on an outer wall of the outer housing.

9. The micro Ethernet connector of claim 1, wherein the surface area of the outer housing is at least 25% less than the surface area of a standard female RJ45 connector.

10. The micro Ethernet connector of claim 1, wherein the shape disposed on the side surface of the inner housing of the micro Ethernet connector extends in a direction parallel to a top and a bottom end of the inner housing, and the shape of a second side surface on an opposite side of the inner housing of the micro Ethernet connector having a different shape than the shape disposed on the side surface of the inner housing of the micro Ethernet connector.

11. The micro Ethernet connector of claim 10, wherein the shape disposed on the side surface of the inner housing of the micro Ethernet connector is concave.

* * * * *